US005503573A

United States Patent [19]

Sagawa

[11] Patent Number: 5,503,573

[45] Date of Patent: Apr. 2, 1996

[54] ELECTRICAL CONNECTOR WITH REUSABLE LOCKING DEVICE

[75] Inventor: Tetsuya Sagawa, Yamato, Japan

[73] Assignee: The Whitaker Corporation, Wilmington, Del.

[21] Appl. No.: 370,943

[22] Filed: Jan. 10, 1995

[30] Foreign Application Priority Data

Feb. 28, 1994 [JP] Japan ..... 6-030009

[51] Int. Cl.[6] ..... H01R 13/436

[52] U.S. Cl. ..... 439/752

[58] Field of Search ..... 439/752, 595

[56] References Cited

U.S. PATENT DOCUMENTS 4,867,712 9/1989 Kato et al. ..... 439/752
5,066,252 11/1991 Kato et al. ..... 439/752
5,203,722 4/1993 Kinoshita ..... 439/595
5,252,096 10/1993 Okada ..... 439/752

*Primary Examiner*—Gary F. Paumen
*Attorney, Agent, or Firm*—Adrian J. LaRue

[57] ABSTRACT

The locking device 30 is intended for locking contacts 11, and is inserted in the opening 26 made in the side wall 27 of the connector housing 20, which has long and narrow openings 36 made in a back surface 31a of the lower wall 31 of the locking device 30 and extending through its entire width. Inside these openings 36, arms 37 for a fully-locked position are made as an integral part of the locking device which start from the wall in which the openings 36 are formed and extend in a longitudinal direction of the locking device 30. The arms 37 for the fully-locked position are engaged with steps 26a made inside the opening 26, thus preventing extraction of the locking device 30 from the connector housing 20. Reuse of the locking device and increased design freedom for connectors having a locking device inserted through the side wall is therefore possible.

16 Claims, 9 Drawing Sheets

ELECTRICAL CONNECTOR WITH REUSABLE LOCKING DEVICE

FIELD OF THE INVENTION

This invention relates to electrical connectors, especially to connectors in which contacts are locked in the connector housing by means of a locking device inserted through the side wall.

BACKGROUND OF THE INVENTION

Electrical connectors of this type, such as described in U.S. Pat. No. 5,203,722 have an opening running from the side wall of the connector housing through contact cavities and a locking device retaining the contacts in the contact cavities. The locking device is made in the form of a frame and is inserted into this opening. Such connectors are equipped with latching elements preventing the locking device from slipping out of the opening. The latching elements may be either on the locking device or on the connector housing.

In the connectors previously described, latching elements are provided in the back lower end of the locking device which trip in the fully locked position. At the left and right ends of the locking device, latching elements for temporary locking are provided. However, since this locking device is of a considerable length, there is a possibility that it will experience plastic deformation in the connector housing. Therefore, the locking device cannot be used again if the connector is replaced. In order to be able to reuse the locking device, it must have sufficient elasticity.

In Japanese Patent Publication 91-9276, a connector having latching elements with sufficient elasticity is described. In this connector, latching elements are provided on the side of the connector housing; they have sufficient flexibility and extend in the direction of the height of the locking device. However, in the connectors with this type of latching elements, it is necessary to sacrifice a part of contact cavities in order to achieve sufficient latching element flexibility thereby resulting in a lower contact density. This imposes limitations on the freedom of design of the connectors having a certain number of contacts or on the elasticity of the locking device.

SUMMARY OF THE INVENTION

This invention takes into consideration the information mentioned above, and its purpose is to offer a connector having a locking device with latching elements suitable for multiple reuse, as well as to provide a high degree of design freedom.

In order to achieve the above stated purposes, connectors having a locking device intended to retain the contacts are characterized by the fact that openings are made in the back surface of the wall. These openings run lengthwise of the locking device into which latching elements are fitted to prevent the fully inserted locking device from becoming loose. These latching elements are an integral part of the locking device and extend in a longitudinal direction.

The latching elements used in the connectors according to this invention have sufficient length in the lengthwise direction of the locking device to undergo only elastic deformation, Multiple reuse of the latching devices is therefore possible.

In addition, since these latching elements are made inside the back portion of the wall of the locking device, which is otherwise dead space, there is no need to sacrifice contact holding cavities. This gives a wider selection of options, such as connectors with a higher density of contacts or reduction of the contact sizes.

BRIEF DESCRIPTION OF THE DRAWINGS

Embodiments of the invention will now be described by way of example with reference to the accompanying drawings in which:

FIG. 1 is a back view; FIG. 2 is a top view; FIG. 3 is a front view and FIG. 4 is a side view.

FIG. 5 is a back view; FIG. 6 is a top view; FIG. 7 is a front view and FIG. 8 is a side view.

FIG. 13 is a top view; FIG. 14 is a front view; FIG. 15 is a bottom view and FIG. 16 is a side view.

FIG. 17 is the view from the back; FIG. 18 is a top view; FIG. 19 is the front view and FIG. 20 is a side view.

FIG. 24 is taken through a different section than FIG. 23.

DETAILED DESCRIPTION OF THE PREFERRED EMBODIMENTS

Figure 1:
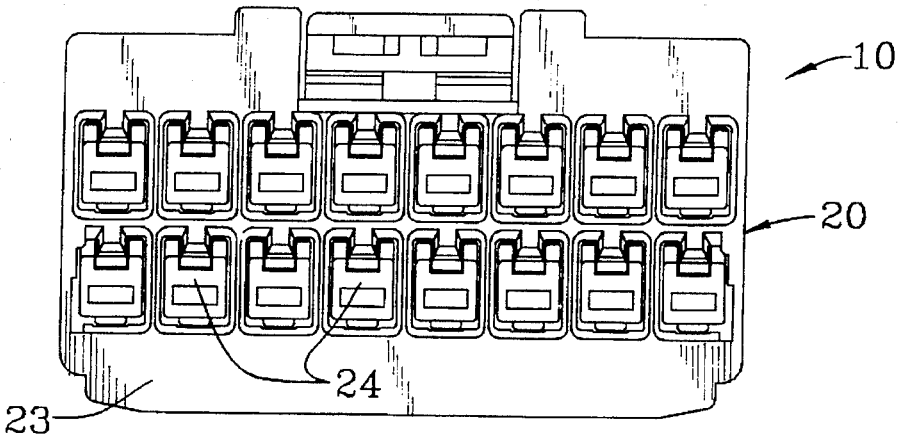
FIGS. 1–4 show the first embodiment of the connector according to this invention, where
Figure 2:
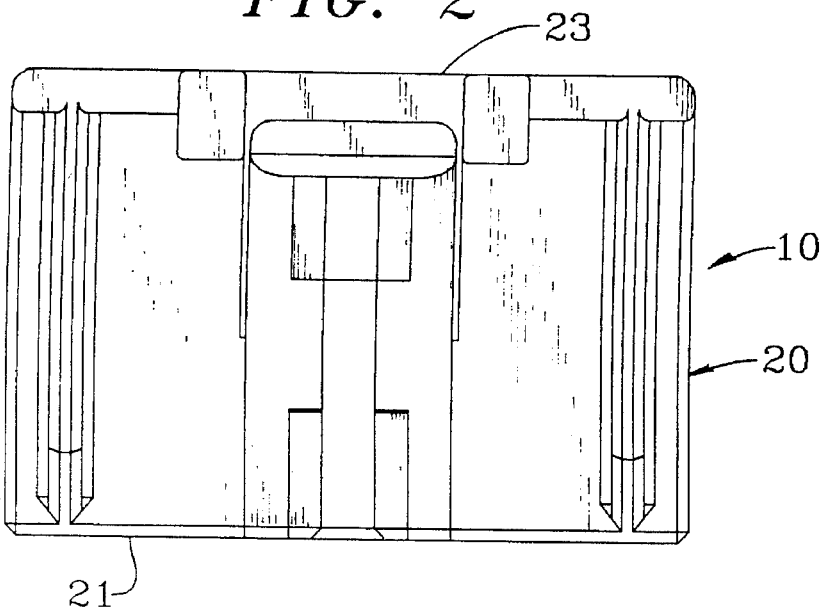
Figure 3:
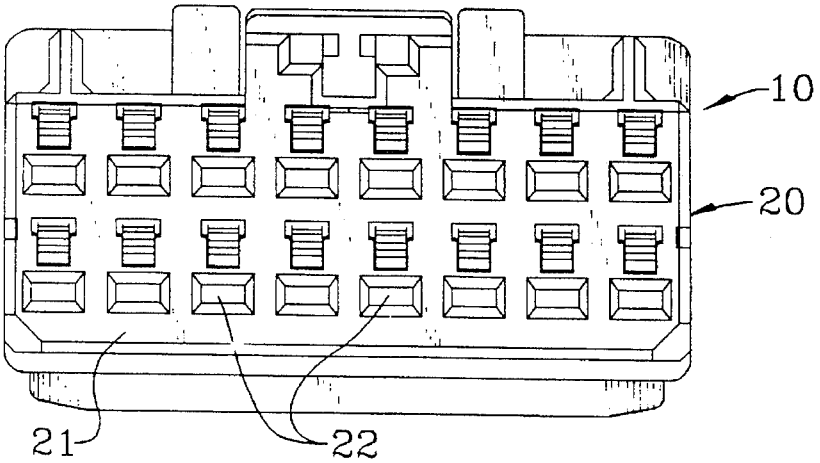
Figure 4:
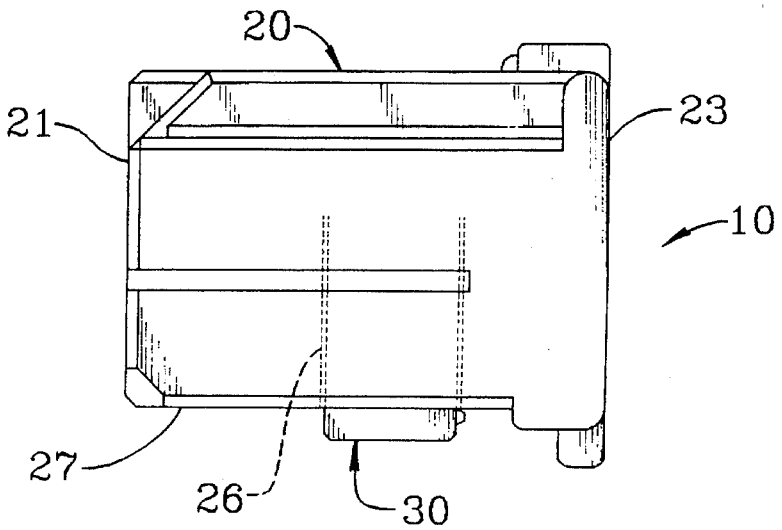

FIGS. 1–4 represent the first embodiment of the connector according to this invention, where FIG. 1 is a back view; FIG. 2 is a top view; FIG. 3 is the front view and FIG. 4 is a side view. The connector 10 shown in the drawings comprises a connector housing 20 and a locking device 30.

Figure 11:
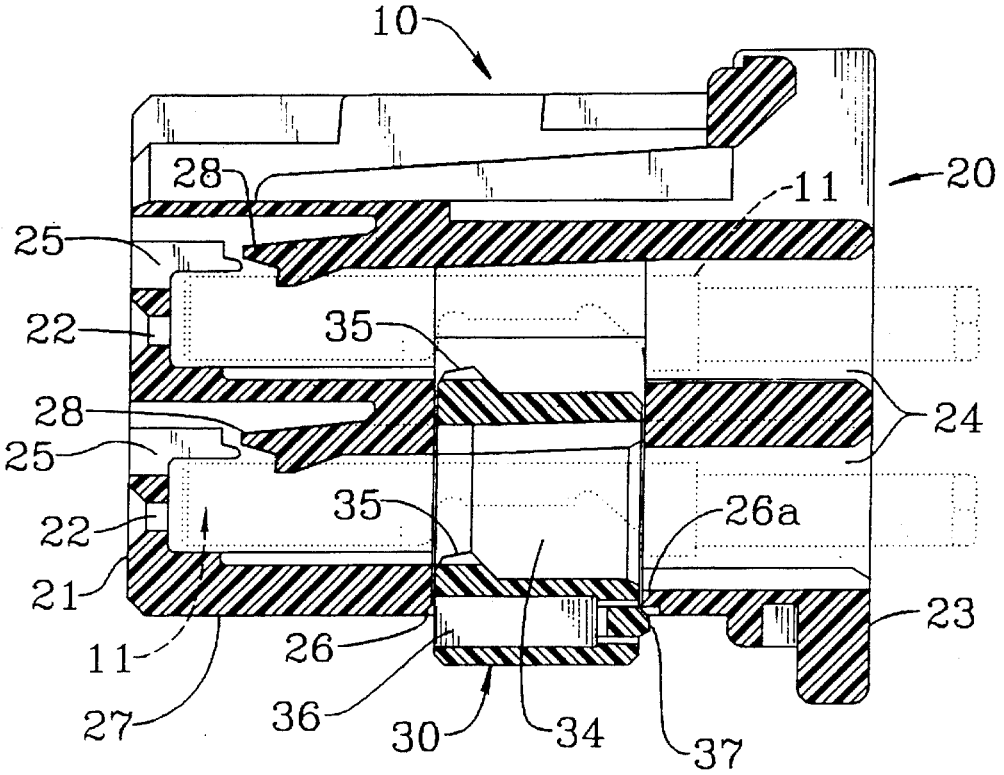
FIG. 11 is a cross-sectional view of the connector shown in FIGS. 1–4, with the locking device in the temporary locked position.
Figure 12:
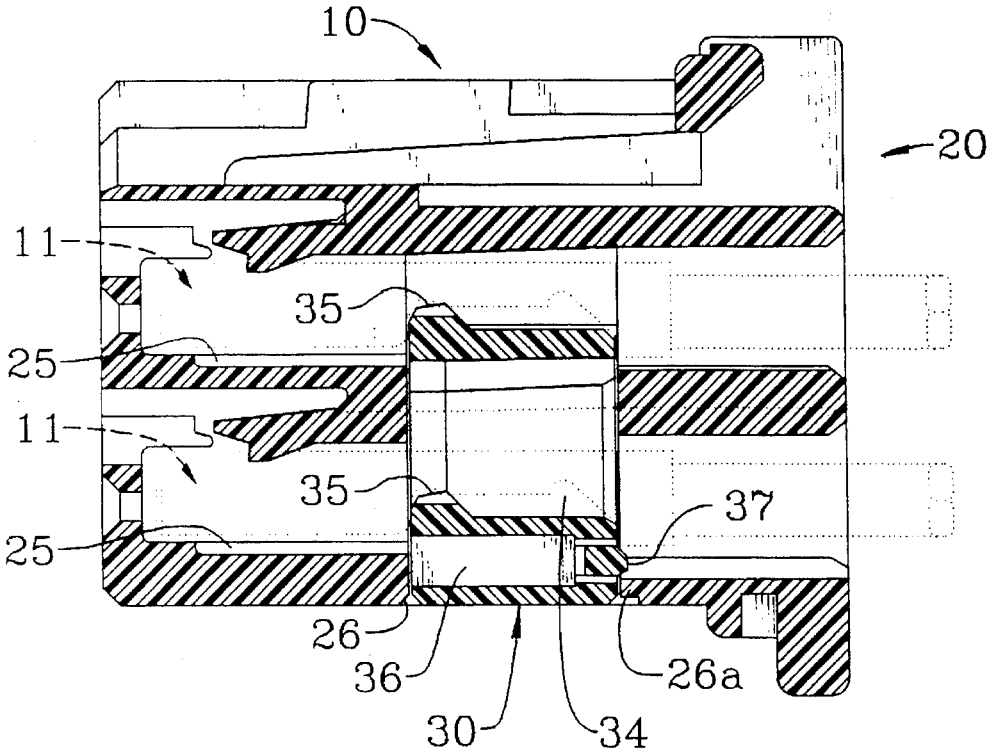
FIG. 12 is a cross-sectional view of the connector shown in FIGS. 1–4, with the locking device in the fully locked position.

In the joining front surface 21 of the connector housing 20, openings 22 for the reception of contacts (not shown in the drawing) of the matching connector are provided. In the connector's back surface 23, openings 24 are provided for contacts 11 (not shown in the FIGS. 1–4 but shown in FIGS. 11 and 12). FIGS. 11 and 12 show the position of these contacts in the connector housing 20. These openings 22 and 24 are arranged in two rows, and they are connected by means of contact cavities 25. The contact cavities 25 extend between openings 22 and 24 are shown in more detail in FIGS. 11 and 12. In addition, an opening 26 passes through a number of contact cavities 25, and is located in the side wall 27 of the connector housing to accommodate the locking device 30.

Figure 5:
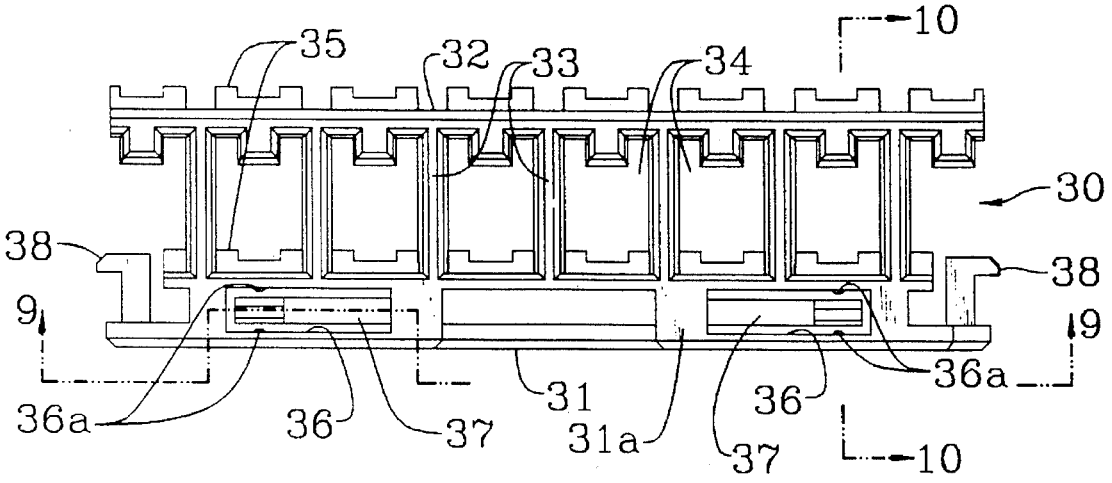
FIGS. 5–8 show the details of the locking device used in the connector shown in the FIGS. 1–4, where
Figure 6:
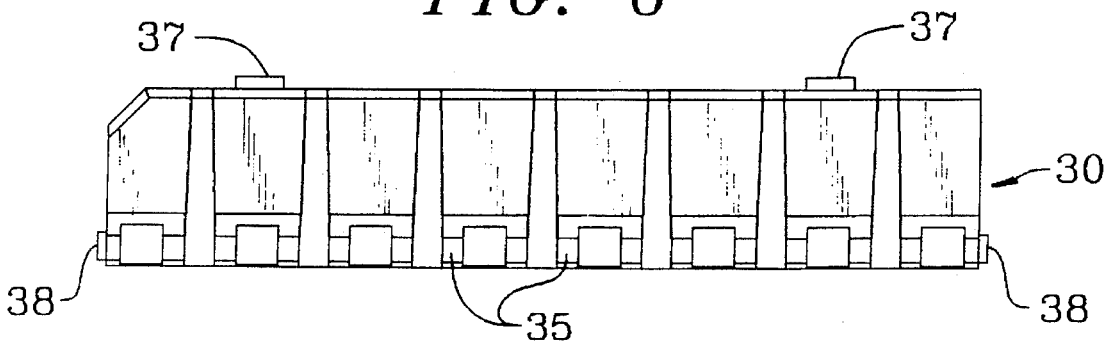
Figure 7:
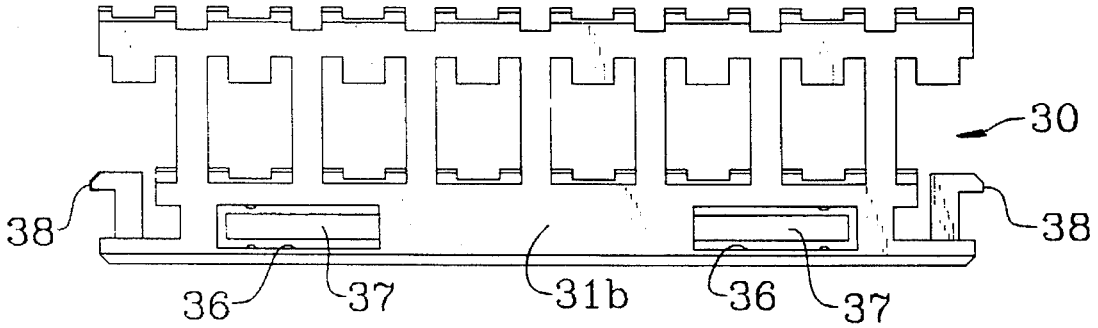
Figure 8:
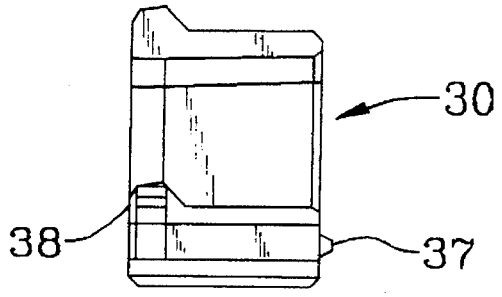
Figure 9:
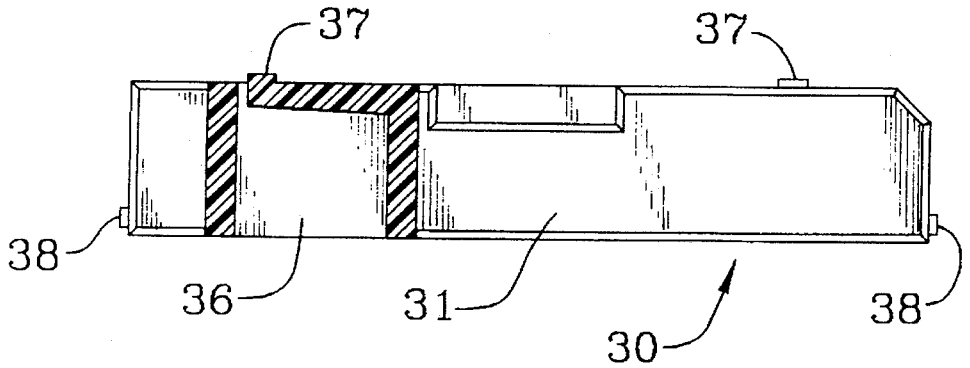
FIG. 9 is a cross-sectional view taken along the line 9—9 in FIG. 5.
Figure 10:
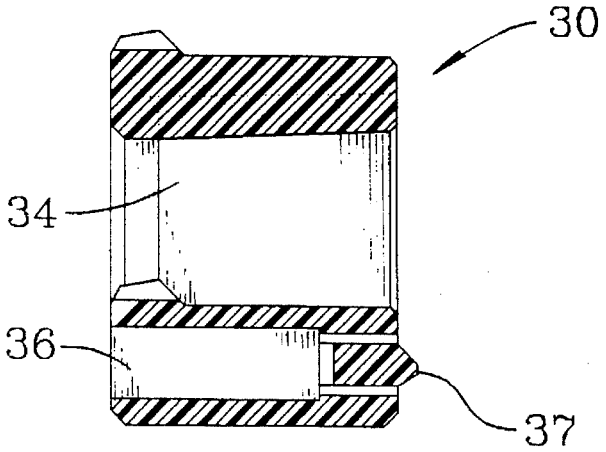
FIG. 10 is a cross-sectional view taken along the line 10—10 in FIG. 5.

FIGS. 5–8 show the locking device 30 used in the embodiment of FIG. 1–4 in greater detail, where FIG. 5 is back view; FIG. 6 is a top view; FIG. 7 is the front view and FIG. 8 is a side view of the locking device.

As can be seen from the FIG. 5–8, the locking device 30 comprises a lower wall 31 extending the entire length of the device, and an upper wall 32 parallel to the wall 31. Longitudinal partitions 33 arranged at a certain predetermined distance from each other are made between the lower and upper walls 31 and 32. The lower wall 31, the upper wall 32 and partitions 33 form one row of throughholes 34 for the contacts. As explained below, these contact throughholes 34 are located in the area corresponding to the temporary locked position of the locking device 30, and are aligned with the lower row of the contact cavities 20 of the connector housing 20. On the upper surfaces of the lower wall 31 and the upper wall 32 of the locking device 30, lugs 35 are provided for locking contacts 11 in the contact cavities 25 when the locking device 30 is in fully locked-position.

Two long and narrow openings 36 are located at the back end 31*a* of the lower wall 31 of the locking device 30. These openings 36 extend through to the front end 31*b* of the lower wall 31. Locking arms 37, extending the entire length of the openings 36, are located in openings 36. These locking arms 37 are an integral part of the locking device 30. Small projections 36*a* are located on the upper and lower walls of the openings 36. These small projections 36*a* limit the deviation of the locking arms 37 in up and down direction in order to attain smooth elastic operation of the locking arms 37 and to achieve reliable locking with the connector housing 20 in the fully locked position. At the right and left sides of the lower wall 31 of the locking device 30, latching arms 38 are made for temporarily locking the locking device 30 in opening 26 in housing 20.

Next, the operation of this embodiment will be explained. Vertical cross sectional views of the connector shown in FIG. 11 and 12 represent a state when the locking device 30 is in a temporary locked position (shown in FIG. 11) and in the fully locked position (shown in FIG. 12).

When the locking device 30 is in the temporary-locking position of FIG. 11 with the locking device 30 in the opening 26 of the connector housing 20, the temporary-latching arms 38 of the locking device 30 become engaged with the depressions (not shown in FIG. 11) made in the inner walls of the opening 26, thus providing temporary locking against the connector housing 20. In this temporary locked position, the openings 34, which permit insertion of contacts, are aligned with the lower row of the contact cavities 25. In this position the lugs 35 of the upper wall 31 and the lower wall 32 of the locking device 30 are in such a position so that they do not interfere with insertion of the contacts 11 into the contact cavities 25. The inserted contacts 11 are kept away from the inner walls of the connector housing 20 by means of housing lances 28 extending inside of the contact cavities 25. Housing lances 28 provide primary locking of the contacts 11 in the connector housing 20.

After all the contacts 11 have been installed in the primary-locked position, the locking device 30 is moved further into the opening 26, until the locking arms 37 become engaged with the steps 26*a* located inside the opening 26. Engagement of locking arms 37 with the steps 26*a* occurs in the fully-locked position of the locking device 30 in the connector housing 20. In this fully-locked position, all the lugs 35 of the locking device 30 are pressed against the back end of the contact sections of the contacts 11, thus providing the secondary locking of the contacts 11 relative to the connector housing 20. Since all contacts 11 are double locked by the housing lances 28 and the lugs 35 of the secondary locking device 30, they are reliably secured from the possibility of being extracted through openings 24.

Figure 13:
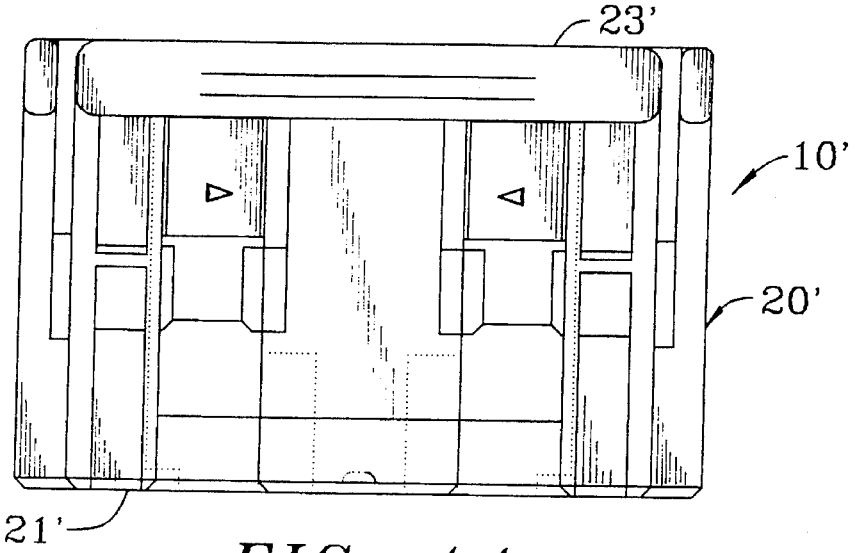
FIGS. 13–16 show a second embodiment of the connector according to this invention, where
Figure 14:
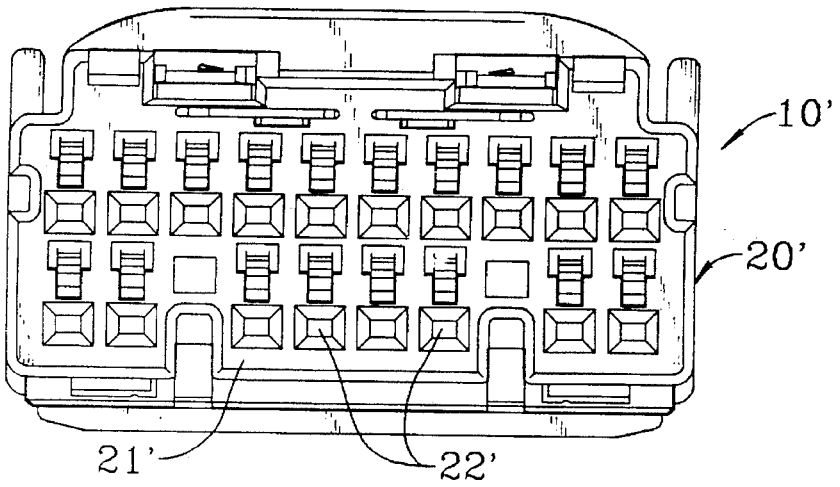
Figure 15:
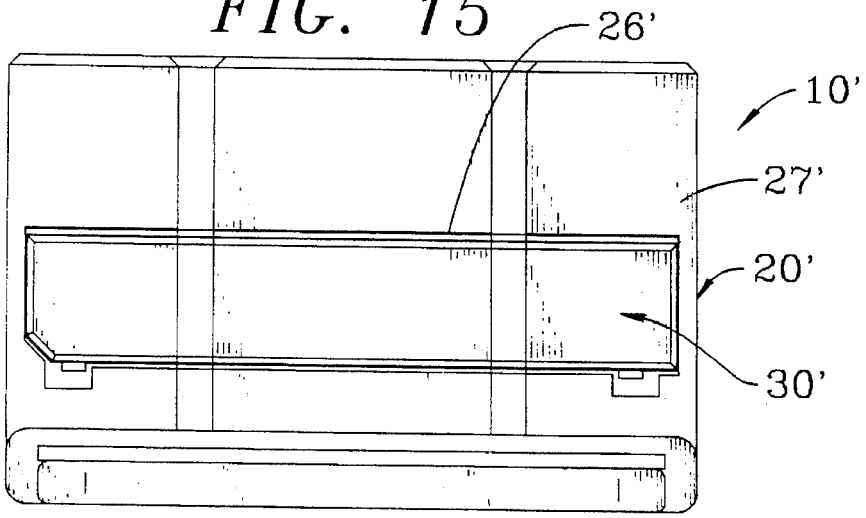
Figure 16:
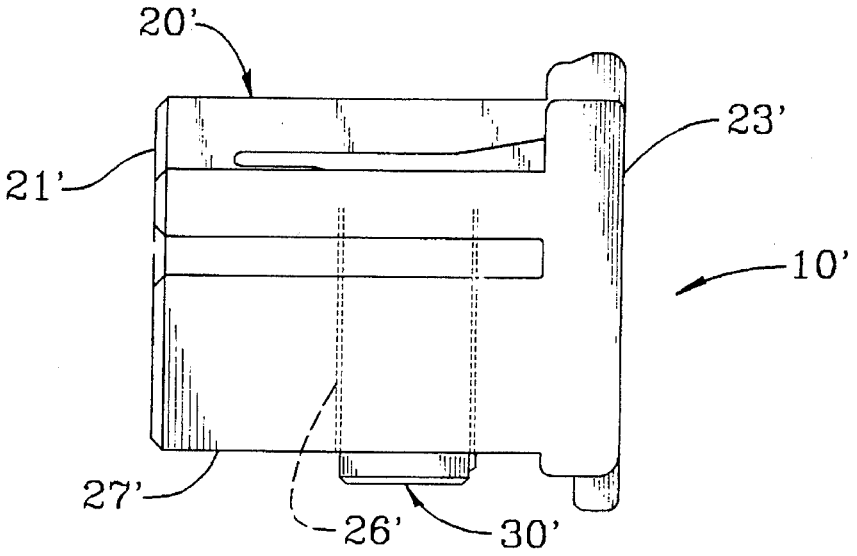
Figure 17:
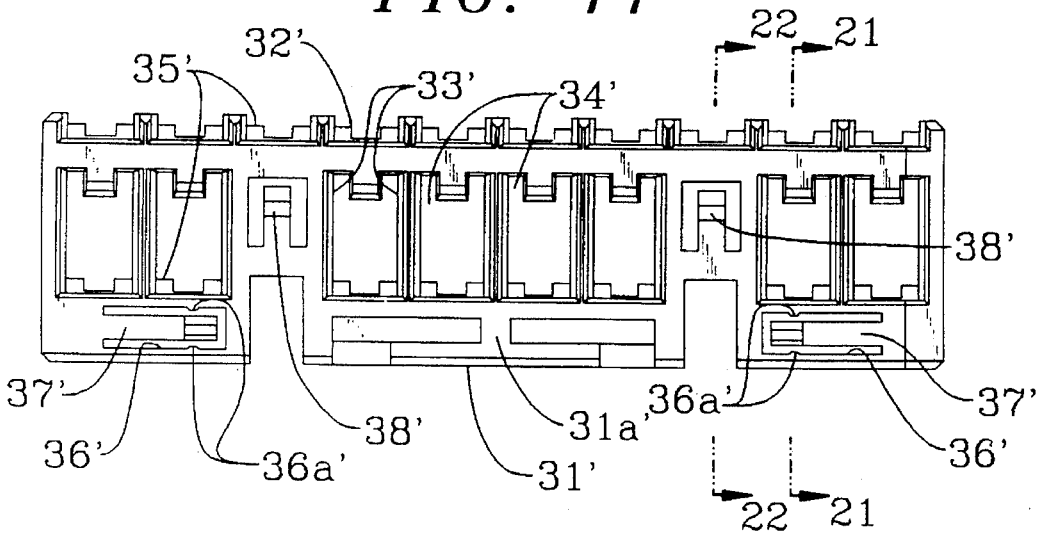
FIGS. 17–20 show details of the locking device used in the connector shown in the FIGS. 13–16, where
Figure 18:
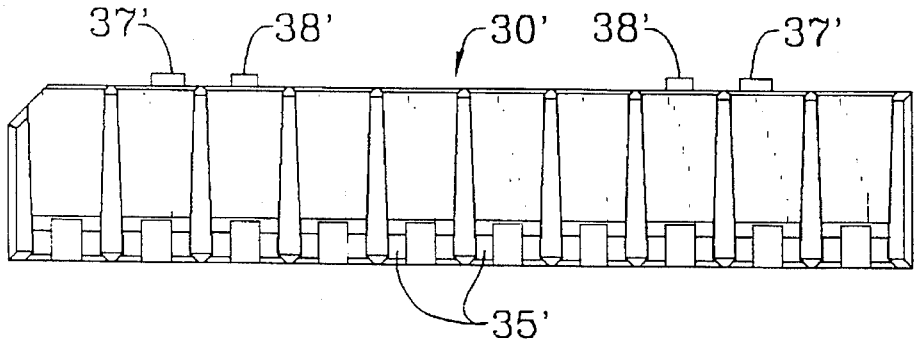
Figure 19:
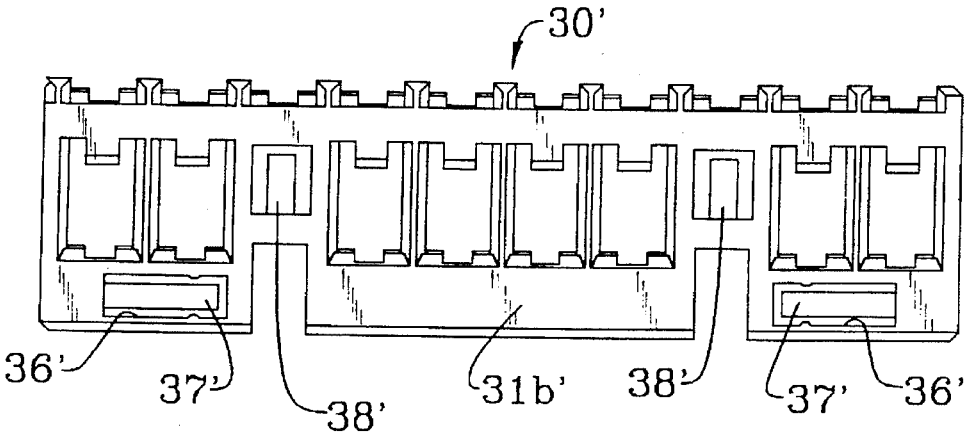
Figure 20:
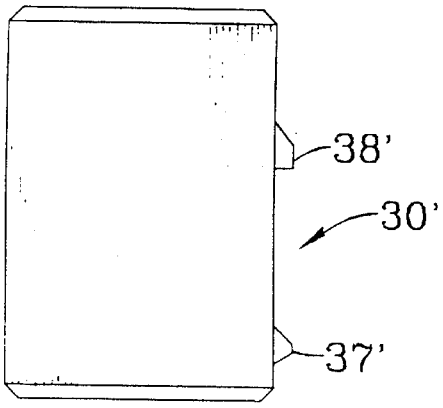
Figure 21:
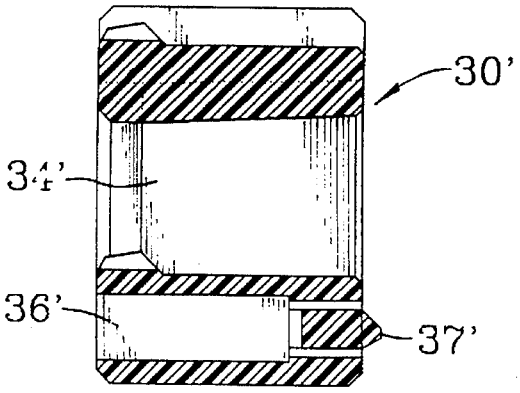
FIG. 21 is a cross-sectional view along the line 21—21 in FIG. 17.
Figure 22:
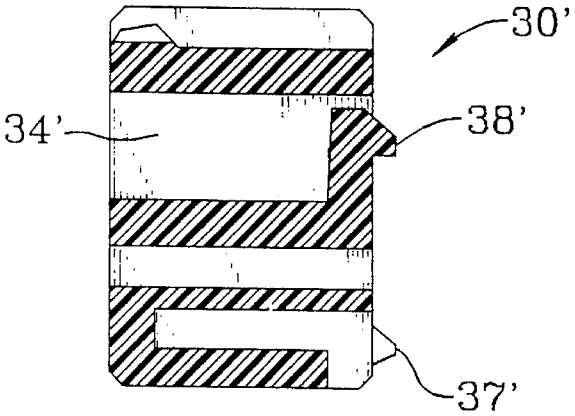
FIG. 22 is a cross-sectional view along the line 22—22 in FIG. 17.

Next, the second embodiment of the connector according to this invention will be discussed. FIGS. 13–16 represent the second embodiment of the connector according to this invention, where FIG. 13 is the top view; FIG. 14 is the front view; FIG. 15 is the bottom view and FIG. 16 is the side view. FIGS. 17–20 show the locking device shown in FIGS. 13–16 in more detail, where FIG. 17 is the view from the back; FIG. 18 is a top view; FIG. 19 is the front view and FIG. 20 is the side view.

This embodiment is different from the previous one by location of the temporary locking arms 38'. Namely, the temporary-latching arms 38' in this embodiment are made between the openings 34' for the insertion of contacts in order to impart a greater elasticity to the temporary-latching arms 38'. For this reason, the number of the openings 34' for the insertion of contacts is reduced compared to the previous embodiment, as well as the number of the contact cavities 25' in the lower row of the connector housing 21'.

Figure 23:
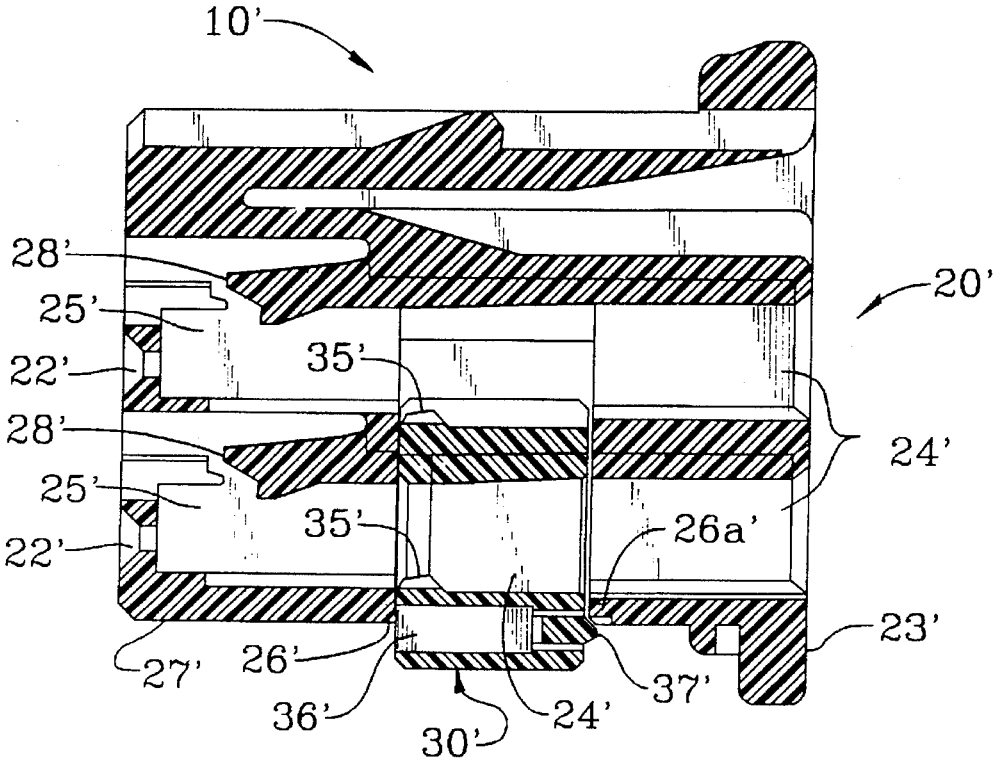
FIG. 23 is a cross-sectional view of the connector shown in FIGS. 13–16, with the locking device in the temporary locked position.
Figure 24:
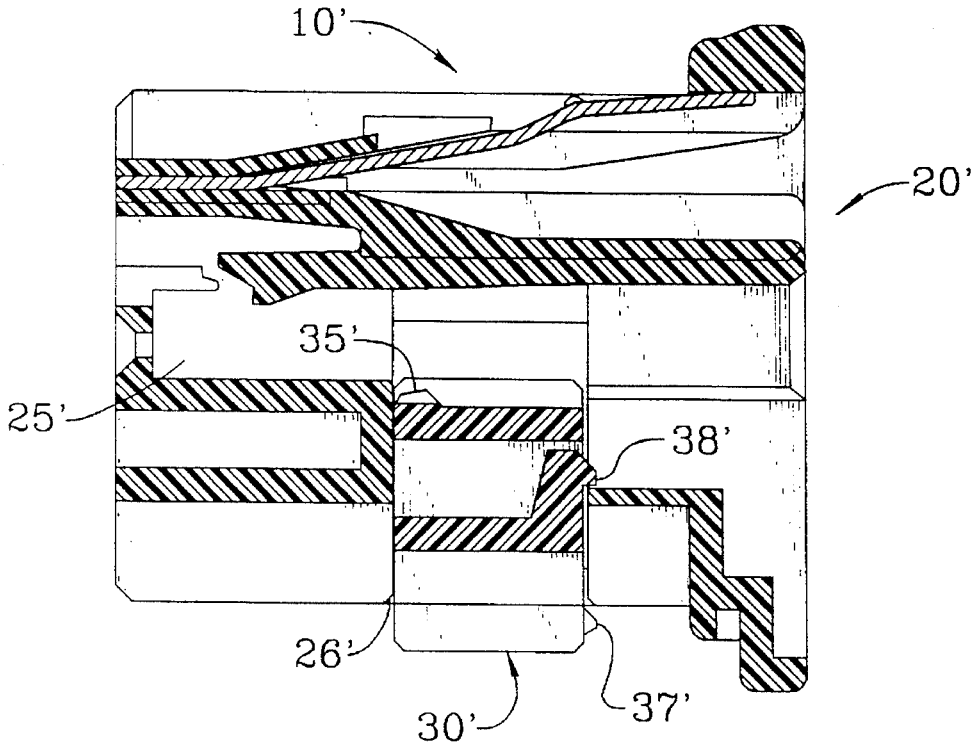
FIG. 24 is a cross-sectional of the connector shown in FIGS. 13–16, with the locking device in the temporary locked position.

FIGS. 23 and 24 show a vertical cross section of the connector shown in FIGS. 13–16. In both FIGS. 23 and 24, the locking device 30' is in the temporary-locked position. In FIG. 23, the locking device 30' is sectioned to show the locking arms 37' when the locking device is in the temporary-locked position. In FIG. 24 the locking device 30' is sectioned in such a way as to show the temporary-latching arms 38' when the locking device is in the temporary-locked position. The operation of this embodiment is different from the previous embodiment only by the fact that when the locking device 30' is in the temporary-locked position, the temporary-latching arms 38' are engaged with the back walls of the openings 26' of the connector housing 20'.

In the first and the second embodiments described above, openings 36, 36' are made in the back surface 31*a*, 31*a'* of lower wall 31, 31' of the locking device 30, 30'. Inside these openings 36, 36', locking arms 37, 37' for fully-locked position are located which extend through the entire length of these openings. Therefore, these locking arms 37, 37' have sufficient elasticity. Because of this, it is possible to repeatedly reuse such a locking device 30, 30' having locking arms 37, 37'. In addition, these openings 36, 36' are made in the portion of the connector which is usually a dead space, and since the locking arms 37, 37' for the fully-locked position are located thereat, the contact cavities 25 in the first embodiment can be arranged thereby attaining a high density. In the second embodiment, the arms 38' for the temporary-locked position are located between the openings 34' for the insertion of contacts in order to improve their elasticity. All these features make it possible to increase the freedom in designing connectors 10, 10'.

Embodiments of connectors according to this invention have been explained hereinabove. However, this invention is not limited to only these specific embodiments, but also comprises various modifications thereof.

I claim:

1. An electrical connector comprising a connector housing having a number of contact-accommodating cavities arranged in rows, and a locking device in the form of a frame which is inserted in a first opening in the connector extending across said contact-accommodating cavities, characterized in that at least one second opening is provided in the back surface of a wall section running lengthwise of said locking device, and that at least one latching element is provided for securing said locking device in the first opening and preventing it from being separated from the connector housing, said latching element comprising an integral part of the locking device and extending in the lengthwise direction of said locking device;

wherein the lengthwise direction of said locking device inserted in said first opening, extends across said contact-accommodating cavities;

wherein said latching element is positioned in said second opening;

wherein said locking device includes multiple lengthwise second openings; and wherein said latching element comprises a cantilever locking arm integral with said locking device.

2. The electrical connector of claim 1 wherein said second opening extends between a back end and a front end of said locking device.

3. The electrical connector of claim 1 wherein said latching element constitutes multiple latching elements positioned in said second openings adjacent the back ends thereof.

4. The electrical connector of claim 3 wherein said locking device includes a lower wall section and an upper wall section, the second openings being in said lower wall section.

5. The electrical connector of claim 4 wherein partitions join said upper and lower wall sections to define contact throughholes, said contact throughholes being aligned with said contact accommodating cavities.

6. The electrical connector of claim 5 wherein said locking device includes lugs on said upper and lower wall sections for engaging contacts in said contact-accommodating cavities, only when said locking device is fully inserted into said first opening.

7. The electrical connector of claim 3 wherein projections in said second openings limit deviation of said latching elements in the up and down direction when said latching elements move towards the front and back of said locking device.

8. The electrical connector of claim 1 wherein said locking device is shiftable between a temporary-locked position and a fully-locked-position.

9. The electrical connector of claim 8 wherein said latching elements engage the exterior of said connector housing when said locking device is in the temporary-locked position and engage an interior surface of said connector housing when said locking device is in said fully-locked position.

10. The electrical connector of claim 9 wherein said latching elements are deflectable to permit the locking device to move between the temporary-locked position and the fully-locked position.

11. The electrical connector of claim 10 wherein said locking device includes temporary-latching arms for engaging said connector housing in the temporary-locked position, the temporary-latching arms and the latching elements holding said locking device in the temporary-locked position.

12. The electrical connector of claim 11 wherein said temporary-latching arms are located on opposite ends of said locking device.

13. The electrical connector of claim 11 wherein said temporary-latching arms are located between said latching elements.

14. The electrical connector of claim 1 wherein said locking device is shifted into said first opening to a fully-locked position and said latching element extends transversely relative to the direction in which said locking device is shifted into said first opening.

15. The electrical connector of claim 1 wherein said connector includes housing lances in each contact-accommodating cavity.

16. The electrical connector of claim 15 wherein said housing lances comprise primary-locking members for holding contacts in said contact-accommodating cavities as said locking device defines a secondary-locking device when positioned in a fully-locked position in said first opening.

* * * * *